United States Patent [19]

Küttelwesch

[11] 4,386,509

[45] Jun. 7, 1983

[54] DEVICE FOR EXTRACTING WATER FROM LAUNDRY

[75] Inventor: Rudolf Küttelwesch, Niedernhausen, Fed. Rep. of Germany

[73] Assignee: MEWA Mechanische Weberei Altstadt GmbH, Wiesbaden, Fed. Rep. of Germany

[21] Appl. No.: 345,376

[22] Filed: Feb. 3, 1982

Related U.S. Application Data

[62] Division of Ser. No. 188,993, Sep. 22, 1980, Pat. No. 4,332,047.

[30] Foreign Application Priority Data

Oct. 4, 1979 [DE] Fed. Rep. of Germany ..... 2940217

[51] Int. Cl.[3] ..... D06F 31/00; D06F 39/08

[52] U.S. Cl. ..... 68/20; 68/207

[58] Field of Search ..... 8/149.1, 158; 68/5 C, 68/18 C, 20, 207, 6, 23.5, 196, 197, 210

[56] References Cited

U.S. PATENT DOCUMENTS

| | | | |
|---|---|---|---|
| 1,234,498 | 7/1917 | Seymour, Jr. | 68/20 X |
| 1,948,568 | 2/1934 | Faber et al. | 68/5 C X |
| 2,023,013 | 12/1935 | Faber et al. | 68/23.5 X |
| 2,502,965 | 4/1950 | Knapp | 68/23.5 |
| 3,115,457 | 12/1963 | Simons | 68/196 X |

*Primary Examiner*—Philip R. Coe
*Attorney, Agent, or Firm*—Spencer & Kaye

[57] ABSTRACT

In a laundering process which includes providing steam at high pressure, directly blowing the steam into fresh water in order to heat the water, and washing and rinsing laundry using the heated fresh water, the step of directly blowing is carried out by delivering at least part of the steam into the fresh water by directing that steam through the laundry which has been rinsed while subjecting the steam to a pressure reduction in a manner to cause the steam to extract rinse water from the laundry which has been rinsed, and conducting the steam and the extracted rinse water into the fresh water in order to heat the fresh water with accompanying condensation of the steam.

Apparatus for extracting rinse water in the manner described above from laundry in a laundry plant in which laundry is washed and rinsed with water which has been heated by blowing steam into the water, the apparatus including: a pressure vessel having an open top and a bottom wall provided with perforations for the passage of water; a container for holding water which will subsequently be used for washing and rinsing laundry outside of the vessel and arranged to receive water passing via the perforations in the vessel bottom wall; a removable cover for closing the top of the vessel in a sealed manner; and conduits connected for introducing steam into the vessel to enable the steam to pass through the bottom wall perforations and into the water holding container.

6 Claims, 1 Drawing Figure

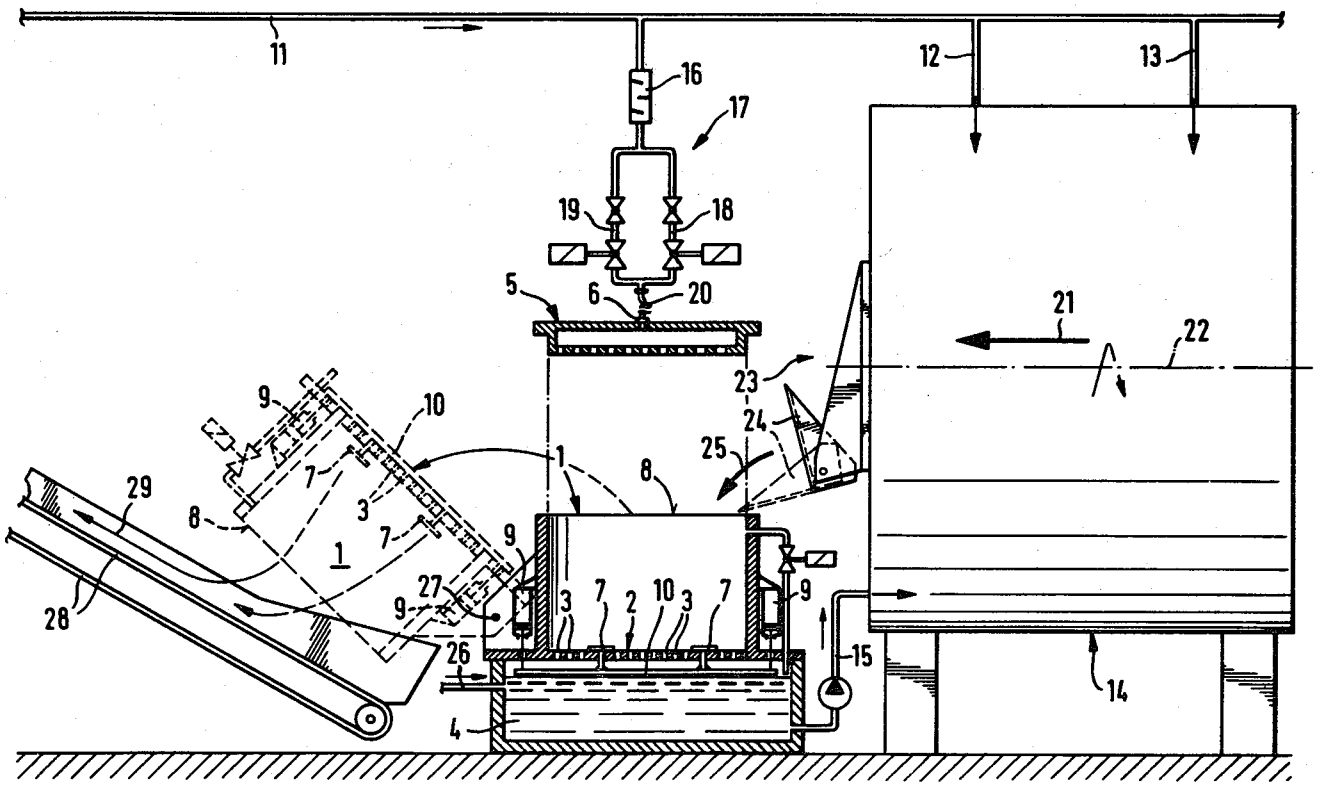
11
12
13
14
15
16
17
18
19
20
21
22
23
24
25
26
27
28
29
1
2
3
4
5
6
7
8
9
10

DEVICE FOR EXTRACTING WATER FROM LAUNDRY

CROSS-REFERENCE TO RELATED APPLICATION

This application is a division of application Ser. No. 188,993, filed Sept. 22, 1980, now U.S. Pat. No. 4,332,047.

BACKGROUND OF THE INVENTION

The present invention relates to apparatus for extracting water from a washload, particularly in the commercial laundry field.

In commercial laundries, washing takes place essentially continuously by passage of the items being washed through so-called counterflow washing machines in which fresh water is added at the end of the machine for rinsing the laundry. From there, the fresh water then flows, increasingly loaded with dirt, through the main washing and prewashing zones. The fresh water is heated, particularly in the main washing zones, by directly blowing in steam, for which purpose the saturated steam pressure of approximately 10–13 bars, as it is usually employed in laundries, is reduced to about 3–5 bars, so as to prevent unnecessary noise development due to the otherwise high speed of the steam when entering into the stationary water baths. In any case, the existence of pressurized steam and its use as the heating means during work in the actual laundering process is an important factor for the present invention.

The extraction of water from rinsed laundry is generally effected by means of friction rollers, presses or centrifuges whose operating speed is limited and which require additional energy for their drives. In the diaphragm presses presently mainly used for water extraction, the residual moisture increases suddenly when a pulse time of 2 minutes is not reached. The energy consumption for driving such diaphragm presses is very high, and the investment costs for making available the driving current are correspondingly high.

SUMMARY OF THE INVENTION

It is therefore an objection of the present invention to provide apparatus which enables the investment costs and energy consumption for water extraction to be reduced.

The objects according to the invention are achieved by the provision of apparatus for extracting rinse water from laundry in a laundry plant in which laundry is washed and rinsed with water which has been heated by blowing steam into the water, which apparatus is composed of: a pressure vessel having an open top and a bottom wall provided with perforations for the passage of water; means for holding water which will subsequently be used for washing and rinsing laundry at a location outside of the vessel and arranged to receive water passing via the perforations in the vessel bottom wall; removable cover means for closing the top of the vessel in a sealed manner; and conduit means connected for introducing steam into the vessel to enable the steam to pass through the bottom wall perforations and into the water holding means.

According to the present invention, part of the steam known to be required to heat the fresh water is initially used to press the water out of the laundry in the water extraction unit. For this purpose, the steam is simply conducted through the laundry itself. This does not require any additional equipment due to the natural pressure drop between the side where the laundry is put into the water extraction unit and the discharge side for the rinse water. The steam is forced or pressed through the laundry under its own pressure in order to extract the water and finally condenses in a water reservoir connected to the water extraction unit through which flows all of the fresh water required for the laundering process and into which is also conducted the rinse water pressed out of the laundry. This heats the wash water from an inlet temperature of about 15° C. to about 30°–35° C. Thus it is no longer necessary, as was previously the case, to heat the wash water in the washing machine itself from about 15° C., and instead heating in the washing machine starts from about 35° C., to the required washing temperature of, for example, 95° C. Thus no additional steam is required for the water extraction according to the invention because after the extraction process the latent thermal energy in the steam is utilized practically to its full extent for heating the fresh water.

The water extraction effected in apparatus according to the present invention thus requires no complicated machines and no availability of electric current connections for momentarily high current consumption. However, the savings in energy is of particular significance and it will be explained in detail with the aid of the example that follows:

Experience has shown that in commercial laundries 80% of the total quantity of laundry needs to be pressed and ironed and only about 20% of the laundry just requires drying. It is known that laundry to be pressed and ironed should have a residual moisture content of about 35% for further processing. However, known water extraction methods achieve only a residual moisture content of about 45% so that, in order to obtain the optimum ironing moisture, an additional drying process must be included.

With the water extraction process effected in apparatus according to the invention, no further drying is required subsequent to the water extraction process for laundry that is to be pressed and ironed. The normally occurring subsequent evaporation of water from the laundry removed from the water extraction device makes it possible that merely shaking the laundry, for example in an unheated dryer, results in an optimum residual moisture content for the subsequent processing stages. This alone saves about 50% of the heating energy required in the prior art for the entire drying process. The above-mentioned subsequent evaporation of water from the hot laundry coming from the water extraction device has the additional result that, in the final analysis, the water extraction process according to the present invention gives the water-extracted laundry to be pressed and ironed a residual moisture content which is lower than that achieved by prior art water extraction devices, and which is optimum for subsequent processing.

In the operation of a preferred embodiment of the invention, the steam is initially provided as saturated steam at an initial pressure of at least 10 bars and the steam is then subject to pressure reduction to superheat it. This takes advantage of the fact that in commercial laundries saturated steam is available with a starting pressure of about 10–13 bars, which is used to heat the heat registers in dryers and the pressing surfaces in steam presses and ironing devices.

Preferably the degree of pressure reduction is made adjustable. This allows account to be taken of laundry batches having different consistencies and allows water to be extracted with greater or lesser ease. For example, a steam pressure of 5 bar has been found to be optimum for the extraction of water from cotton laundry and a steam pressure of 2 bar has been found optimum for the extraction of water from mixed fibers. Because of their polyester component, it is easier to extract water from laundry of mixed fibers.

BRIEF DESCRIPTION OF THE DRAWING

The sole FIGURE is a partly schematic, partly cross-sectional elevational view of a laundry plant equipped with a preferred embodiment of an extraction device according to the invention.

DESCRIPTION OF THE PREFERRED EMBODIMENTS

The water extraction device provided in the plant shown in the Figure essentially includes a pressure vessel 1, whose bottom 2 is provided with perforations 3 to give the bottom 2 a sieve-like form. Below the pressure vessel 1 there is arranged a fresh water tank 4 into which water and steam are introduced via the perforations 3 and in which this steam condenses due to the presence of fresh water supplied via an inlet conduit 26 at an initial temperature of about 15° C.

The fill opening 8 of the pressure vessel 1 can be locked by means of a removable pressure locking cover 5. The pressure locking cover 5 is provided with a connection 6 for the introduction of steam used for water extraction.

A plurality of push rods 7 pass through the bottom 2 of the pressure vessel 1. The push rods 7 are driven from the underside of the pressure vessel 1 to be displaceable in the direction toward its fill opening 8. They are driven by means of pneumatic or hydraulic drive cylinders 9 which are arranged opposite one another at the outside of the pressure vessel 1 and act in a driving manner on a traverse rod 10 extending below the pressure vessel parallel to its bottom, the lower ends of the push rods 7 being rigidly fastened to this traverse rod 10.

In a steam conduit 11, saturated steam is available at a pressure of about 10–13 bar. This steam is conducted in the usual manner, mainly after a reduction of the pressure to about 3–5 bar, through conduits 12 and 13 so as to heat the water for the washing and rinsing machine 14. The washing and rinsing machine 14 is supplied with fresh water from the fresh water tank 4 through a fresh water conduit 15. Machine 14 is provided at its outlet end with a slide 24 movable between the raised position shown in solid lines and the lowered position shown in broken lines.

High pressure saturated steam from the steam conduit 11 is conducted through a steam dryer 16 into a pressure reducing device 17 where the steam is superheated and simultaneously the superheated steam is reduced through a line 18 of conduits, throttles and a control valve to a pressure of about 2 bar or the steam is reduced through a line 19 of conduits, throttles and a control valve to a pressure of about 5 bar. The outlet of the pressure reducing device 17 is connected to the connection 6 of the pressure locking cover 5 by means of a flexible hose 20. Depending on the type of laundry from which water is to be extracted, the high pressure saturated steam is conducted from conduit 11 through the line of conduits 18 or 19 to the water extraction device.

The illustrated apparatus operates as follows:

Laundry travels in a set rhythm in the direction of the arrow 21 through the drum of the washing and rinsing machine 14 while that drum rotates about the axis 22, and the laundry continues toward the discharge end 23. From there a batch of the rinsed laundry weighing about 35–50 kg is ejected in the direction of the arrow 25 over the slide 24 in its lowered position shown in broken lines. Then the laundry batch is filled into the pressure vessel 1 of the water extraction device and uniformly distributed over its bottom. Thereafter, the slide 24 is pivoted upwardly into the position shown in solid lines and the pressure vessel 1 is closed in a pressure tight manner by moving down the pressure locking cover 5.

Then steam is supplied through hose 20 and flows through the laundry in vessel 1 which, laden with the rinse water, covers the entire bottom 2 of the pressure vessel 1 to an essentially uniform thickness. The steam then passes through the perforations 3 in the bottom 2 of the pressure vessel 1 and condenses within the fresh water tank 4 disposed below the pressure vessel 1.

The steam flowing through the laundry and the perforations 3 essentially presses the rinse water out of the laundry and into the fresh water tank 4.

After the water extraction process, which requires only a very short time, the pressure locking cover 5 is lifted again. The pressure vessel 1 itself is pivoted about the axis 27 into its tilted position shown in dashed lines. Then the drive cylinders 9 mounted on vessel 1 are actuated so that the pressure plungers 7 connected therewith eject any laundry still adhering to the pressure vessel 1 out via the fill opening 8 of the pressure vessel 1 onto a conveyor belt 28 on which the water-extracted laundry is brought in the direction of the arrow 29 to the next processing station, i.e. a loosening device. In the loosening device itself, there occurs a subsequent evaporation of the steam still present in the laundry with the effect of further drying so that an optimum pressing or ironing wetness is attained with a residual moisture content of about 25% without the consumption of any further energy.

For containing approximately 70 respectively 100 pounds of rinsed laundry the vessel has an inside diameter of 100 cm respectively 120 cm and an inside height of 60 cm. The holding capacity is 470 respectively 680 liters. The reaction time of the steam on the laundry for performing the water extraction process is not longer than 45 sec. The steam flow-rate is approximately 1 pound steam/2 pounds of laundry. The steam pressure is adjustable in the range of 1 to 6 bar, depending on the desired residual moisture content of the laundry.

Due to the influx of the water extraction steam and of the water pressed out of the laundry by the steam, the fresh water supplied through conduit 26 at an inlet temperature of about 15° C. is already heated to about 30°–35° C. This fresh water, which is heated in the fresh water tank, is then supplied to the washing and rinsing machine 14 in the usual manner through fresh water conduit 15 where it is further heated by steam supplied through conduits 12 and 13.

It is to be understood that the above description of the present invention is susceptible to various modifications, changes and adaptations, and the same are intended to be comprehended within the meaning and range of equivalents of the appended claims.

What is claimed is:

1. Apparatus for extracting rinse water from laundry in a laundry plant in which laundry is washed and rinsed with water which has been heated by blowing steam into the water, said apparatus comprising:

a pressure vessel having an open top and a bottom wall provided with perforations for the passage of water;

means for holding water which will subsequently be used for washing and rinsing laundry at a location outside of said vessel and arranged to receive water passing via the perforations in said vessel bottom wall;

removable cover means for closing the top of said vessel in a sealed manner; and conduit means connected for introducing steam into said vessel to enable the steam to pass through said bottom wall perforations and into said water holding means.

2. Apparatus as defined in claim 1 further comprising:

at least one push rod passing through said vessel bottom and guided to be displaceable relative thereto; and means connected for driving said push rod from below the bottom of said vessel for displacing said rod in the direction toward said top of said vessel.

3. Apparatus as defined in claim 2 further comprising means supporting said pressure vessel for pivotal movement relative to said water holding means between a water extraction position in which the open top of said vessel is directed upwardly and a laundry removal position in which the open top of said vessel is directed generally downwardly.

4. Apparatus as defined in claim 3 wherein said vessel is pivotal into its laundry removal position only when said cover means is removed from said vessel.

5. Apparatus as defined in claim 3 further comprising conveyor means disposed to receive laundry from said vessel when said vessel is in its laundry removal position and operative for conveying laundry away from said vessel.

6. Apparatus as defined in claim 1 further comprising means supporting said pressure vessel for pivotal movement relative to said water holding means between a water extraction position in which the open top of said vessel is directed upwardly and a laundry removal position in which the open top of said vessel is directed generally downwardly.

* * * * *